United States Patent [19]

Ohanessian

[11] Patent Number: 4,711,488

[45] Date of Patent: Dec. 8, 1987

[54] GARMENT HANGER

[76] Inventor: Stephen Ohanessian, 734 W. Hyacianth, West Covina, Calif. 91791

[21] Appl. No.: 899,233

[22] Filed: Aug. 22, 1986

[51] Int. Cl.[4] ..... A47C 7/62

[52] U.S. Cl. ..... 297/190; 297/191

[58] Field of Search ..... 297/190, 191, 188, 403

[56] References Cited

U.S. PATENT DOCUMENTS

| | | | |
|---|---|---|---|
| 119,794 | 10/1871 | Schlag | 297/191 |
| 1,473,702 | 11/1923 | Guthridge et al. | 297/190 X |
| 2,262,581 | 11/1941 | Gonczy | 297/190 |
| 2,284,811 | 6/1942 | Ferrelle | 297/191 X |
| 2,320,215 | 5/1943 | Brenner | 297/190 |
| 2,759,529 | 8/1956 | Hagadorn | 297/191 |
| 4,111,484 | 9/1978 | Jaeger | 297/410 |

FOREIGN PATENT DOCUMENTS

| | | | |
|---|---|---|---|
| 2045018 | 1/1972 | Fed. Rep. of Germany | 297/190 |

*Primary Examiner*—Francis K. Zugel

*Attorney, Agent, or Firm*—James E. Brunton

[57] ABSTRACT

A garment hanging apparatus which can be built into an upholstered chair of standard design or, alternatively, can be attached to a chair of standard design which has been modified to receive the apparatus. The design of the apparatus is such that it can be used to properly support garments, such as suit coats, without in any way interfering with the normal use of the chair.

4 Claims, 4 Drawing Figures

FIG. 1
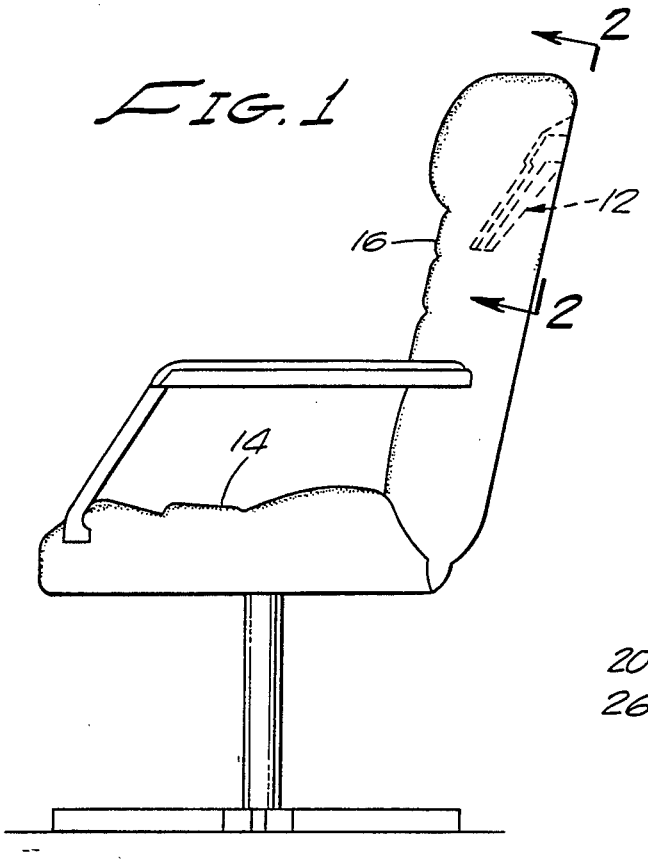
FIG. 3
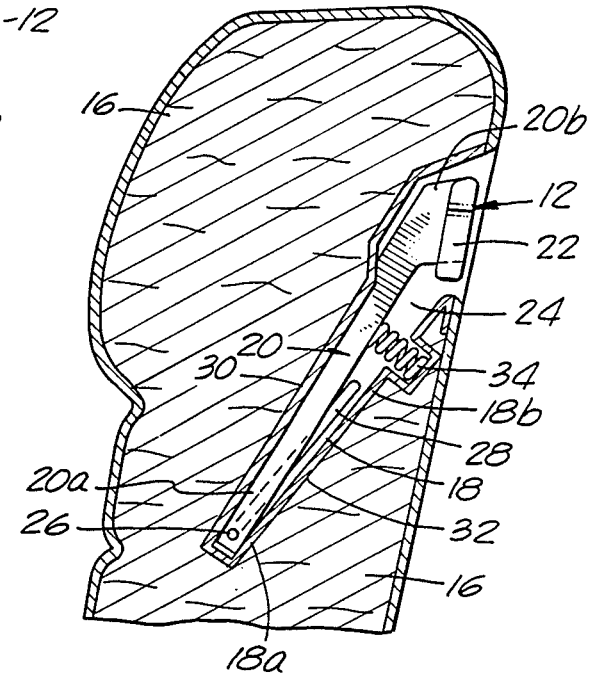
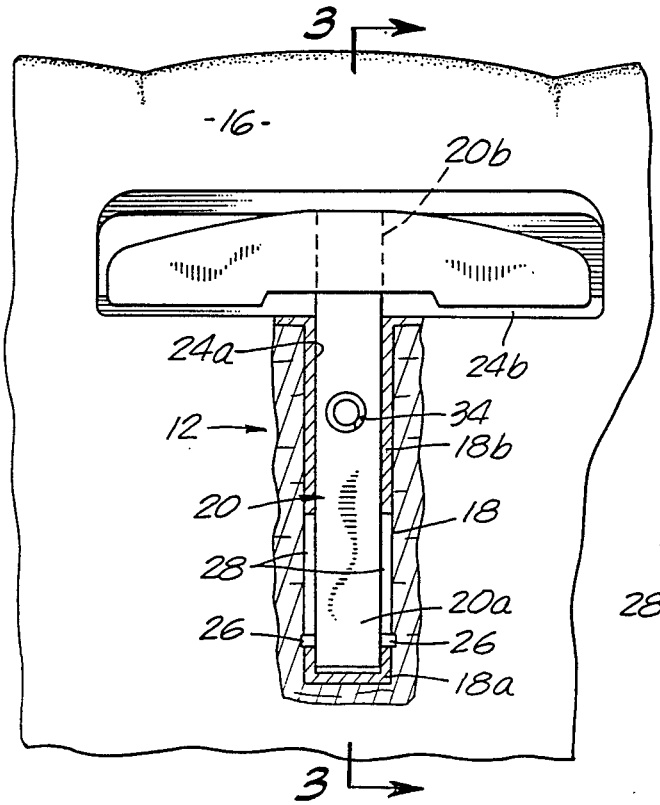
FIG. 2
FIG. 4
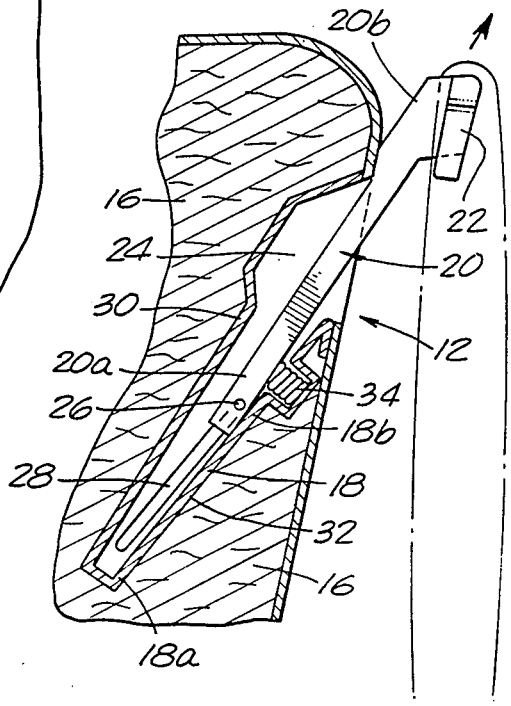

GARMENT HANGER

BACKGROUND OF THE INVENTION

1. Field of the Invention

The present invention relates generally to garment hangers. More particularly the invention concerns a garment hanging apparatus which can be built into an upholstered chair of standard design or, alternatively, can be attached to a chair of standard design which has been modified to receive the apparatus.

2. Discussion of the Prior Art

It is common practice, both in the home and in business offices, to hang garments, such as suit coats, over the back of a chain. This is undesirable because the garment usually becomes wrinkled when the person using the chair leans back against the back of the chair over which the garment has been draped. Additionally, the garment interferes with the use and comfort of the chair.

While various types of coat hanger attachments for chairs have been suggested in the past, most interfere in some way with the normal use of the chair. Exemplary of such devices is the device shown in U.S. Pat. No. 846,911 issued to Crump.

The apparatus of the present invention overcomes the drawbacks of prior art garment hanging devices by providing a garment hanging apparatus which does not interfere with the normal use of the chair and can either be built into, or attached to, an upholstered chair of standard design. In the preferred form of the invention, when the garment hanger is not in use, it can conveniently be stored in an interior chamber formed within the back of the chair. When it is desired to hang a garment on the device, the hanger assembly can quickly and easily be withdrawn from the interior chamber and extended outwardly and rearwardly upwardly from the back of the chair. In its extended position a suit coat or other garment can conveniently be draped over the hanger portion of the device without in any way interfering with the normal use of the chair.

SUMMARY OF THE INVENTION

It is an object of the present invention to provide a garment hanging apparatus which can be installed on a chair of conventional design for use in hanging suit coats and like garments in a manner so as to properly support and protect the garment and yet not interfere with the normal use of the chair.

Another object of the invention is to provide a garment hanging apparatus of the aforementioned character which, when not in use, can conveniently be stored within an internal chamber formed in the back of an upholstered chair.

Still another object of the invention is to provide a garment hanging apparatus as described in the preceding paragraph which is uniquely constructed so that the hanger portion of the apparatus can quickly and easily be removed from the storage chamber of the chair and extended upwardly and rearwardly to a position spaced apart from the chair back.

Another object of the invention is to provide a garment hanging apparatus of the class described which embodies a minimum number of moving parts, is reliable in use, and can be manufactured at a minimum cost.

Still another object of the invention is to provide a chair embodying a novel retractable garment hanging apparatus which is both attractive and functional thereby being ideally suited for use in business offices and the like.

BRIEF DESCRIPTION OF THE DRAWINGS

FIG. 1 is a side elevational view of a chair embodying the garment hanging apparatus of the present invention.

FIG. 2 is an enlarged cross-sectional view taken along lines 2—2 of FIG. 1.

FIG. 3 is a cross-sectional view taken along lines 3—3 of FIG. 2 showing the appearance of the garment hanger apparatus adapter when it is fully retracted within the chair.

FIG. 4 is a cross-sectional view similar to FIG. 3 but illustrating the appearance of the apparatus when the coat hanger portion is withdrawn from the storage compartment or internal chamber formed within the chair and the apparatus is in an operative configuration.

DESCRIPTION OF THE INVENTION

Referring to the drawings, and particularly to FIGS. 1, 2 and 3, the garment hanging attachment of the present invention, generally designated by the numeral 12, is shown interconnected with an upholstered chair of standard design, having a seat portion 14 and an interconnected back portion 16. In the embodiment of the invention shown in the drawings, the garment hanging attachment comprises a first member 18 secured to the upstanding back portion of the chair and a second member 20 operably associated with first member 18. First member 18 has first and second extremities **18*a* and 18*b*. As best seen by referring to FIGS. 2 and 4, first member 18 is secured to the upstanding back portion of the upholstered chair proximate its first end portion 18*a*. Second member 20 has first and second end portions 20*a* and 20*b* respectively and is connected proximate its first end 20*a* to first member 18 for movement between a first retracted position as shown in FIG. 3 to a second extended position shown in FIG. 4**.

As illustrated in FIG. 4, a hanger means is connected proximate the second end **20*b* of second member 20 for supporting a garment when the second member 20 is in the second, or extended, position shown in FIG. 4. In the present form of the invention, the hanger means comprises a specially configured transversely extending member 22 which is affixed proximate end 20*b* of second member 20. While member 22** can have various configurations adapted to support garments of various types, it is here shown in a configuration adapted to support a garment such as a suit coat or the like.

In the form of the invention shown in the drawings, the coat hanger apparatus is mounted within a storage chamber 24 formed internally of chair back portion 16. With this construction, end **18*a* of first member 18 is mounted internally of chamber 24 proximate the lower extremity thereof. As best seen by referring to FIG. 2, in this form of the invention, second member 20 is provided with spaced apart transversely extending ears 26 which are receivable within tracks, or channels, 28 formed in first member 18. With this construction, second member 20 is slidably movable relative to first member 18 from the first position shown in FIGS. 2 and 3 wherein member 20 is in close proximity to front chamber wall 30 to the second extended position shown in FIG. 4 wherein member 20 is spaced from wall 30**.

Also forming a part of the apparatus of the present embodiment of the invention is a biasing means adapted to act upon second member 20 when said member is in the first retracted position shown in FIG. 3. The function of the biasing means is to yieldably urge the second member 20 toward the front wall 30 of chamber 24 and away from the rear wall 32 of the chamber. The biasing means is here provided in the form of a coiled spring 34 having one end carried within a recess formed in rear wall 32 of the storage chamber and having its opposite free end in pressural engagement with second member 20. As illustrated in FIG. 4, as second member 20 is withdrawn from chamber 24 and moved into its second, or extended, position, coil spring 34 is compressed in the manner shown in FIG. 4.

Turning now to FIG. 2, it can be seen that internal chamber 24 is generally "T" shaped in plan, having a generally vertically extending leg **24*a* and a generally horizontally extending leg 24*b*. As indicated in FIG. 2, the horizontally extending leg 24*b* is of a size to closely receive therewithin the coat hanger 22 of the garment hanging means of the invention. In instances where the back of the upholstered chair is curved, the garment hanger 22** can also be curved to follow the contour of the back of the chair.

For certain applications, the coat hanger attachment of the invention can be mounted externally of the back of the chair with the extremity **18*a* of the first member 18 being pivotally interconnected with the chair back for movement toward and away therefrom. The second member 20 can be slidably mated with member 18** or, in some instances, telescopically mated therewith for movement between a first retracted position and a second elevated position. With such a construction, when the garment hanging attachment is not in use, the first and second members can be moved into close proximity with the chair back and the second member moved relative to the first member into a first, or lowered, position. When it is desired to hang a garment on the garment hanging attachment, the assembly can be pivotally moved away from the plane of the back of the chair and the second member can be moved into a second extended, or upraised, position providing easy access to the hanger portion of the device for hanging suit coats or other garments thereon.

The apparatus of the invention, as well as the storage chamber within which it is housed, can be fabricated of plastic material, lightweight metal or other suitably rigid and durable materials.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An upholstered chair comprising:

(a) a seat portion;

(b) a back portion connected to said seat portion, said back portion being provided with an internal chamber having spaced apart front and back walls;

(c) a first member having first and second ends, said first member being disposed within said internal chamber, said first end thereof being connected to said back portion;

(d) second member having first and second ends said second member being slidably interconnected with said first member for sliding movement between a first retracted position wherein said second member is fully disposed within said internal chamber and a second extended position wherein said second end of said second member extends rearwardly of said back; and (e) garment hanging means carried proximate said second end of said second member.

2. An upholstered chair as defined in claim 1 in which said internal chamber is generally "T" shaped in plan having a generally vertically extending leg and a generally horizontally extending leg and in which said garment hanging means comprises a coat hanger configured to be closely received with said horizontally extending leg of said internal chamber when said second member is in said first retracted position.

3. An upholstered chair as defined in claim 2 including biasing means carried within said internal chamber for yieldably urging said second member toward said front wall of said internal chamber when said second member is in said first retracted position.

4. A chair comprising:

(a) a seat portion;

(b) a back portion connected to said seat portion, said back portion being provided with an internal chamber, generally "T" shaped in plan, having spaced apart front and back walls said back wall having a recess provided therein;

(c) a first member having first and second ends, said first member being disposed within said internal chamber;

(d) a generally "T" shaped second member having first and second ends, said second member being slidably interconnected with said first member for sliding movement between a first retracted position wherein said second member is closely contained within said internal chamber and a second extended position wherein said second end of said second member extends rearwardly of said back; and (e) biasing means carried within said internal chamber for yieldably urging said second member toward said front wall of said internal chamber when said second member is in said first retracted position, said biasing means comprising a coil spring disposed within said recess provided within said back wall of said internal chamber.

* * * * *